United States Patent [19]

Christopher

[11] 4,424,086

[45] Jan. 3, 1984

[54] PYROTECHNIC COMPOSITIONS FOR SEVERING CONDUITS

[75] Inventor: Glenn B. Christopher, Fort Worth, Tex.

[73] Assignee: Jet Research Center, Inc., Arlington, Tex.

[21] Appl. No.: 395,215

[22] Filed: Jul. 6, 1982

Related U.S. Application Data

[62] Division of Ser. No. 193,856, Oct. 3, 1980, Pat. No. 4,352,397.

[51] Int. Cl.[3] ..... C06B 45/10

[52] U.S. Cl. ..... 149/19.3; 149/2; 149/37; 149/40; 102/286; 102/364

[58] Field of Search ..... 149/19.3, 37, 2, 40; 102/364, 286

[56] References Cited

U.S. PATENT DOCUMENTS

| | | | |
|---|---|---|---|
| 3,050,409 | 8/1962 | Bayer | 149/37 |
| 3,649,390 | 3/1972 | Ahlert et al. | 149/37 |
| 3,680,483 | 8/1972 | Staudacher et al. | 149/116 |
| 3,713,636 | 1/1973 | Helms et al. | 102/335 |
| 3,724,372 | 4/1973 | Phillips | 102/364 |
| 3,726,727 | 4/1973 | Ishibashi | 149/37 |
| 3,868,225 | 2/1975 | Tidd | 102/286 |
| 3,890,168 | 6/1975 | Shumway | 149/37 |
| 3,890,174 | 6/1975 | Helms et al. | 149/37 |
| 3,960,087 | 6/1976 | Beatty et al. | 149/116 |
| 4,000,022 | 12/1976 | Beckert et al. | 149/19.3 |
| 4,076,563 | 2/1978 | Zaritsanos et al. | 149/37 |
| 4,216,721 | 8/1980 | Marziano et al. | 102/364 |
| 4,276,353 | 6/1981 | Novinski et al. | 149/2 |
| 4,372,213 | 2/1983 | Rozner et al. | 149/37 |

OTHER PUBLICATIONS

Hawley, "The Condensed Chemical Dictionary", 9th Ed., p. 206, Van Nostrand Reinhold Co. (1977) New York.

Rozner et al., "Jet Cutting of Metals with Pyronol Torch", Naval Surface Weapons Center, U.S.A. Copyright BHRA Fluid Engineering, Cranfield, Bedford MK43 0AJ, England, 1978.

*Primary Examiner*—Edward A. Miller

*Attorney, Agent, or Firm*—Edward F. Sherer; Thomas R. Weaver

[57] ABSTRACT

A stacked load of gas-forming pyrotechnic fuel pellets comprising metal, metal oxide and PTFE in varying amounts for use in apparatus for severing conduits in high pressure environments.

11 Claims, 12 Drawing Figures

PYROTECHNIC COMPOSITIONS FOR SEVERING CONDUITS

This application is a division of application Ser. No 193,856, filed Oct. 3, 1980, and now U.S. Pat. No. 4,352,397.

This invention relates to methods, incendiary apparatus and pyrotechnic fuel compositions for completely severing a conduit from a selected location inside the conduit. The methods, apparatus and compositions of this invention are useful in a variety of applications including, but not limited to, the in situ severing of metal conduits used in drilling, completing and producing oil, gas and water wells at selected downhole locations, the severing of hollow structural members, the severing of pipelines and the severing of other tubular members formed of metal, ceramic, plastic or other material. Thus, the term "conduit" is used hereinafter to mean all types of tubular members susceptible to internal cutting which are formed of metal, ceramic, plastic or the like.

The methods, apparatus and pyrotechnic fuel compositions of the present invention are particularly suitable for severing metal conduits such as drill strings, casing, tubing, etc., in oil, gas and water wells at selected downhole locations. Such metal conduits sometimes become lodged in a well bore below ground level and cannot be retracted from the well bore without damage to and/or loss of substantial parts of the conduit. In such instances, and other similar instances, it has been the practice to lower a cutting tool into the conduit to the location of the obstruction, and to there cut or sever the conduit in order to free at least the upper portion of the conduit.

A variety of conduit cutting tools have been developed and used heretofore. Such tools generally fall into three categories, those of the mechanical milling or cutting type, those which utilize one or more explosive charges, and those which utilize chemicals. The mechanical type of conduit cutter is not only difficult to use but is also very time-consuming in achieving a cut. Cutting tools which include explosive charges bring about a quick severing of a conduit, but such tools can cause a bulge or flare in the conduit at the location of severance and in some instances can create shock waves of sufficient intensity to cause damage to surrounding structures. While chemical cutters can achieve a flare-free cut, they generally will not operate successfully in a conduit which does not contain fluid above the point where the cut is to be made.

Torches of the incendiary type have been developed and utilized heretofore for cutting objects such as heavy steel plate, cable and chain above and below water. For example, such a torch is described in U.S. Pat. No. 3,713,636 to Helms et al. issued Jan. 30, 1973, and in paper "D3" entitled "Jet Cutting of Metals with Pyronol Torch" by A. G. Rosner and H. H. Helms, Jr., presented at the Fourth International Symposium on Jet Cutting Technology, Apr. 12–14, 1978. The torch described in the above-mentioned patent and paper can be utilized for severing relatively thick objects, formed of metal or other material, along planes in alignment with the longitudinal axis of the torch, but it is not operable for severing a conduit in a plane which is transverse to the longitudinal axis of the torch at a desired location from within the interior of the conduit.

Pyrotechnic compositions for use as fuel in incendiary torches have also been developed and utilized heretofore. For example, a pyrotechnic composition containing nickel and aluminum is described in U.S. Pat. No. 3,503,814 issued Mar. 31, 1970 to Helms et al. and improved pyrotechnic compositions containing nickel, aluminum, a metal oxide and a source of gas are described in U.S. Pat. No. 3,695,951 issued Oct. 3, 1972 to Helms et al. It has been found that the pyrotechnic fuel compositions disclosed in the above cited patents can be successfully utilized for severing conduits and other metal objects at atmospheric and relatively low superatmospheric pressure, but that at higher pressures the effectiveness of the compositions in severing conduits decreases. In severing tubular goods in oil, gas and water wells, and in other applications, the severing operation often must be carried out in a high pressure environment.

By the present invention, an improved solid pyrotechnic fuel composition is provided for severing thick objects wherein the severing operation can be carried out in a high pressure environment. In addition, the improved pyrotechnic fuel compositions of the present invention are more economical to produce than other similar compositions and are dependable and efficient in use.

In addition to the improved pyrotechnic compositions, methods and apparatus are provided for severing conduits at desired locations from within the conduits which achieve extremely fast, clean cuts by incendiary means without bulging or flaring the conduits. The apparatus do not require means for locking the apparatus in the conduits bein severed, and after operation, the entire apparatus is retrieved and reused and no debris is left in the severed conduit. The compositions, methods and apparatus of this invention can be efficiently utilized for severing tubular members of a broad range of sizes and wall thicknesses, including tubular members formed of stainless steel and can operate efficiently at high temperature and high pressure environments in air or when immersed in liquids such as water and drilling mud. While the methods and apparatus of the invention can be utilized using various pyrotechnic fuel compositions, the compositions of the present invention are particularly suitable in that they are economical and further, bring about the efficient severing of conduits at high pressures. The term "high pressure" is utilized herein to mean a pressure environment in the range of from about 2000 psia to about 25,000 psia.

The method of the present invention of severing a conduit along a plane extending transversely to the axis of the conduit is comprised of the steps of confining a pyrotechnic fuel composition within a fuel chamber in an elongated housing sized for insertion in the conduit, the housing including a plurality of spaced, radially extending discharge nozzles in communication with the fuel chamber, the nozzles being positioned in the housing so as to direct fuel reaction products in directions substantially transverse to the axis of the housing, positioning the housing inside the conduit with the discharge nozzles thereof lying substantially within a plane extending transversely to the axis of the conduit and adjacent the desired location of severance of the conduit and igniting the pyrotechnic fuel composition confined in the fuel chamber so that reaction products formed therefrom exit the housing by way of the discharge nozzles and impact the conduit thereby severing the conduit. The reaction products formed from the reaction of the compositions of this invention are extremely high temperature, high density products which are directed against the interior wall surfaces of the conduit at high velocity in a plane transverse to the conduit, causing the extremely rapid and flare-free severance thereof.

In the drawings forming a part of this disclosure:

FIG. 6 is an enlarged sectional view of a portion of the apparatus of FIG. 1;

Figure 1:
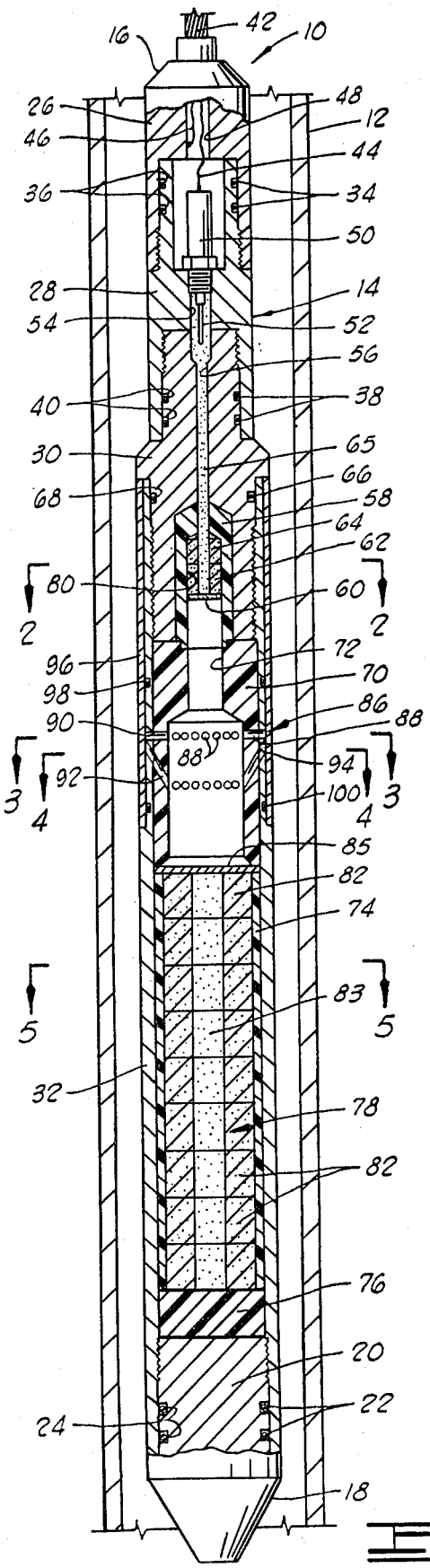
FIG. 1 is a vertical sectional view of one form of the apparatus of the present invention positioned within a conduit to be severed.
Figure 2:
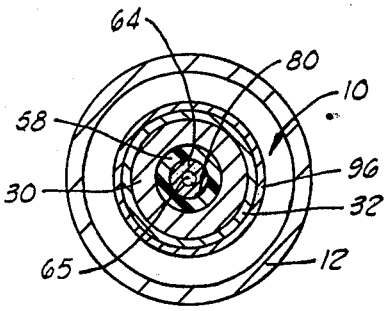
FIG. 2 is a sectional view taken along line 2—2 of FIG. 1.
Figure 3:
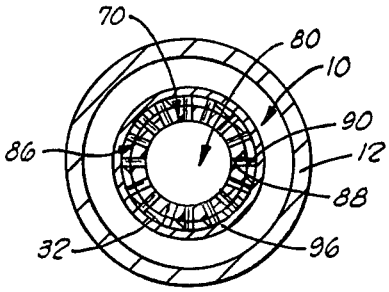
FIG. 3 is a sectional view taken along line 3—3 of FIG. 1.
Figure 4:
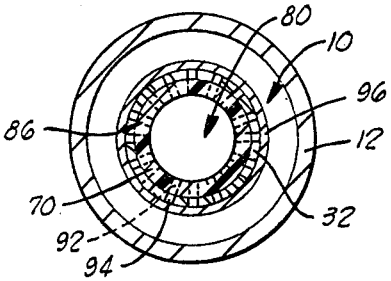
FIG. 4 is a sectional view taken along line 4—4 of FIG. 1.
Figure 5:
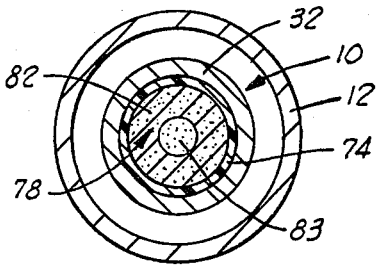
FIG. 5 is a sectional view taken along line 5—5 of FIG. 1.

Referring now to the drawings, and particularly to FIGS. 1-7, one form of the conduit severing apparatus of the present invention is illustrated and generally designated by the numeral 10. In FIG. 1, the apparatus 10 is illustrated positioned in a vertically disposed conduit 12 to be severed.

The apparatus 10 includes an elongated cylindrical housing generally designated by the numeral 14 having an upper end 16 and a lower end 18. The lower end 18 of the housing 14 is closed by a plug 20 which is threadedly connected thereto. A pair of conventional O-rings 22 positioned in annular grooves 24 in the plug 20 provide a fluid-tight seal between the plug 20 and the housing 14. The upper end 16 of the housing 14 is closed by a wireline connector assembly 26.

The housing 14 is comprised of the wireline connector assembly 26, an ignitor subassembly 28 threadedly connected to the assembly 26, a fuel ignition subassembly 30 threadedly connected to the subassembly 28 and a housing sleeve 32 which is threadedly connected to the subassembly 30 and the plug 20. The threaded connection between the wireline connector assembly 26 and the ignitor subassembly 28 includes conventional O-rings 34 disposed in annular grooves 36 in the subassembly 28, and in a like manner, the threaded connection between the subassembly 28 and the ignition subassembly 30 includes conventional O-rings 38 disposed in annular grooves 40 in the subassembly 30.

The wireline connector assembly 26 has a cable or wireline 42 attached to its upper end for lowering and raising the apparatus 10 within the conduit 12. The cable 42 carries electrical leads 44 and 46 which are selectively connected to a source of electric power at the upper end of the cable 42, i.e., at the surface or otherwise outside the conduit 12, and at the lower end of the cable 42, leads 44 and 46 pass through an opening 48 in the assembly 26. The lead 46 is connected to the assembly 26 to thereby ground it to the housing 14 and the lead 44 is connected to an electrical ignitor 50 threadedly connected within the ignitor subassembly 28. The ignitor 50 can take various forms, but generally includes an ignition element 52 which projects into fuel disposed in an ignition passage formed within the housing 14. That is, a centrally positioned passage 54 is disposed in the subassembly 28, the upper portion of which is threaded to engage a threaded portion of the ignitor 50 and into which the ignition element 52 of the ignitor 50 extends. A centrally positioned passage 56 is disposed in the fuel ignition subassembly 30 which communicates with the passage 54 in the subassembly 28 and extends through the subassembly 30.

In the embodiment illustrated in FIG. 1, the lower end portion of the passage 56 in the fuel ignition subassembly 30 is enlarged and a tubular insert formed of heat resistant material 58 is disposed in the recess. The hollow interior of the insert 58, the passage 56 disposed in the subassembly 30 and the passage 54 disposed in the subassembly 28 form a passage extending from the ignition element 52 of the ignitor 50 to the bottom of the ignition subassembly 30. A retainer 60 is installed within the interior of the insert 58, the function of which is to retain solid fuel within the passage. More specifically, a pair of annular solid fuel pellets 62 and 64 formed of a gas-forming pyrotechnic fuel composition are positioned immediately above the retainer 60 within the interior of the insert 58 and the passage formed by the passages 54 and 56 and the central openings in the pellets 62 and 64 are filled with a powdered non-gas-forming pyrotechnic fuel composition 65.

The threaded connection between the housing sleeve 32 and the subassembly 30 includes one or more conventional O-rings 66 disposed in one or more annular grooves 68 in the subassembly 30, and an insert 70 formed of heat resistant material is positioned within the upper portion of the housing sleeve 32 adjacent and in contact with the bottom of the ignition subassembly 30. A centrally positioned passage 72 which communicates with the interior of the insert 58 is disposed in the insert 70. The passage 72 in the insert 70 is enlarged at its lower end, and positioned immediately below and in contact with the insert 70 is a fuel chamber liner 74 formed of heat resistant material. Below the fuel chamber liner 74 and immediately above and adjacent the top of the plug 20 is a removable fuel chamber plug 76 formed of heat resistant material.

The space formed by the plug 76 and the liner 74 within the lower end portion of the housing 14 constitutes a fuel chamber, generally designated by the numeral 78. The passage communicating with the fuel chamber 78 formed by the passage 72 in the insert 70, the interior of the insert 58 in the subassembly 30, the passage 56 in the subassembly 30 and the passage 54 in the subassembly 28 constitutes an ignition passage, generally designated by the numeral 80.

Disposed within the fuel chamber 78 are a plurality of stacked annular fuel pellets 82 formed of a gas-forming pyrotechnic fuel composition and disposed witin the open central portions of the stacked pellets is a powdered non-gas-forming pyrotechnic fuel composition 83. A retainer 85 formed of thin aluminum or the like is positioned at the upper end of the fuel chamber 78 to retain the fuel compositions therein.

Figure 7:
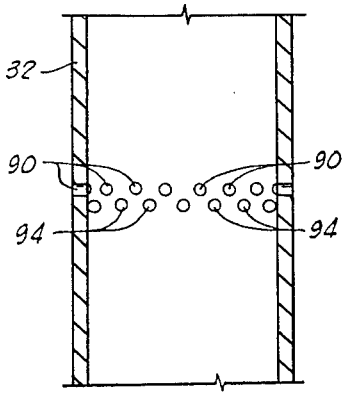
FIG. 7 is an enlarged sectional view of a part of the apparatus illustrated in FIG. 6.
Figure 8:
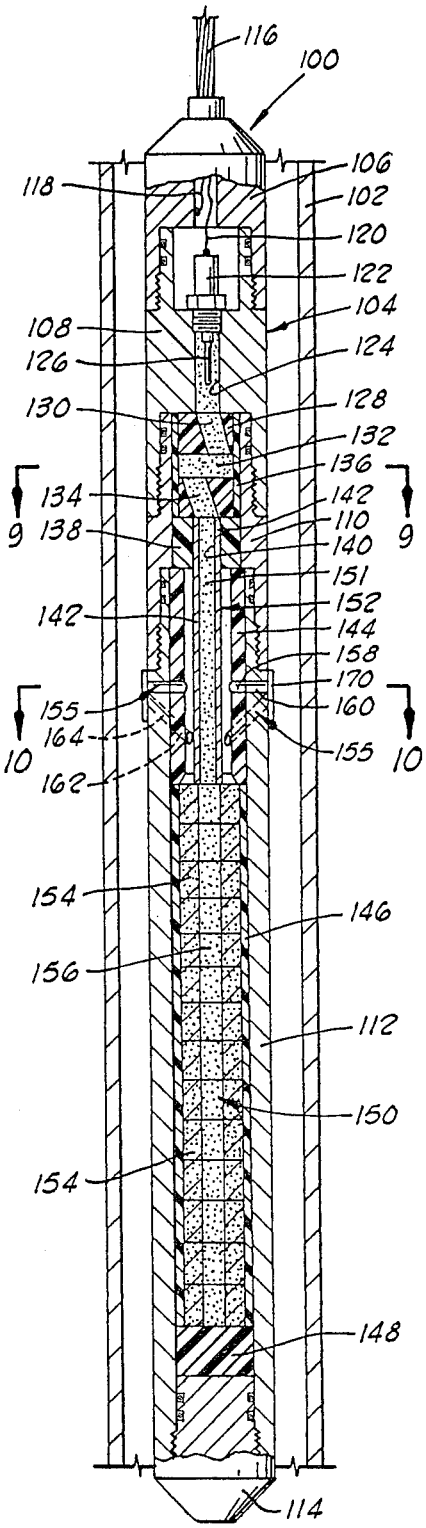

As best shown in FIGS. 1, 6 and 7, a plurality of radially extending discharge nozzles generally designated by the numeral 86 are disposed in the insert 70 and the housing sleeve 32. More specifically, a first set or portion of relatively small diameter passages 88 are disposed through the sides of the insert 70 at the upper end portion of the enlarged recess therein. All of the passages 88 lie in a single plane transverse to the axis of the housing 14. A like number of complementary passages 89 are disposed in the portion of the housing sleeve 32 adjacent the passages 88 in the insert 70 thereby forming nozzles extending from the interior of the enlarged recess in the insert 70 to the exterior of the housing sleeve 32 in a single plane transverse to the axis of the housing 14, preferably perpendicular thereto. A second set or portion of nozzles are formed by passages 92 extending through the sides of the insert 70 and complementary passages 94 extending through the housing sleeve 32. As shown in the drawings, the interior ends or inlets of the passages 92 in the insert 70 all lie in a single plane transverse to the axis of the housing 10, preferably perpendicular thereto, and the passages 92 and complementary passages 94 in the housing sleeve 32 are all inclined upwardly at equal angles whereby the discharge ends of the nozzles formed by the passages 92 and 94 all lie in a single plane transverse to the axis of the housing 10 preferably perpendicular thereto. Preferably, as shown in the drawings, the exterior or discharge ends of the nozzles 86 formed by the passages 92 and 94 lie adjacent the exterior or discharge ends of the nozzles 86 formed by the passages 88 and 90, and as shown in FIG. 7, the discharge ends of the nozzles 86 are staggered, i.e., are not in vertical alignment. While the lower nozzles formed by the passages 92 and 94 can be at various oblique angles designated by the symbol $\theta$ (FIG. 6), the angle $\theta$ is preferably in the range of from about 1° to 60°, and most preferably, 45°.

Attached to the outside of the housing sleeve 32 in a recess provided therefor is a sleeve 96 which functions to seal the nozzles 86 and prevent water, air or other contaminants from entering the interior of the housing 10. Conventional O-rings 98 and 100 are disposed in annular grooves positioned on opposite sides of the nozzles 86 in the housing sleeve 32 to provide a seal between the housing sleeve 32 and the sleeve 96.

In operation of the apparatus 10 for severing the conduit 12 in a plane transverse to the axis of the conduit, the apparatus 10 is lowered by means of a cable 42 within the conduit 12 to a location whereby the nozzles 86 of the apparatus 10 are positioned opposite the desired location of severance of the conduit 12. A source of electric power is then connected or otherwise generated in the electrical leads 44 and 46 whereby a circuit through the ignitor assembly 50 is produced and the ignition element 52 thereof reaches a temperature whereby the powdered pyrotechnic fuel composition 65 within the ignition passage 80 of the apparatus 10 is ignited. The ignition of the powdered non-gas-forming pyrotechnic composition 65 in turn ignites the pellets 62 and 64 in the ignition passage 80. The pellets 62 and 64 are formed of gas-forming pyrotechnic fuel composition and their ignition produces a jet of extremely hot reaction products which burns through the retainer 60 and flows through the ignition passage 80 into contact with the retainer 85 and the pyrotechnic fuel composition in the fuel chamber 78 of the apparatus 10 thereby burning through the retainer 85 and igniting the gas-forming and non-gas-forming pyrotechnic fuel compositions therein. The ignition of the gas-forming fuel pellets 82 in the fuel chamber 78 produces a jet of extremely hot reaction products which flows upwardly within the ignition passage 80 and through the discharge nozzles 86 into contact with the sleeve 96. The hot combustion products burn through the sleeve 96 and impact the interior walls of the conduit 12 thereby burning through the conduit 12 and severing it in a plane transverse to the axis of the conduit 12. Because a portion of the fuel reaction products flows through the upwardly inclined passages 92 and 94 forming jets which are directed upwardly, a downward force is exerted on the apparatus 10. The downward force produced on the apparatus 10 is offset by the cable 42 resulting in the apparatus 10 remaining stationary within the conduit 12 during operation and insuring a clean severance of the conduit 12. Once the pyrotechnic fuel composition within the fuel chamber 78 of the apparatus 10 has all been reacted and the conduit 12 severed by the impingement of jets of hot reaction products thereagainst, the apparatus 10 is retrieved from the conduit 12.

Figure 8:
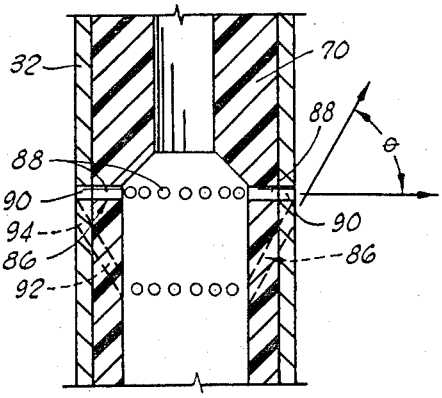
FIG. 8 is a vertical sectional view of an alternate form of the apparatus of the present invention positioned within a conduit to be severed.
Figure 9:
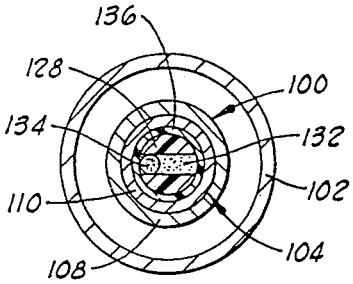
FIG. 9 is a sectional view taken along line 9—9 of FIG. 8.
Figure 10:
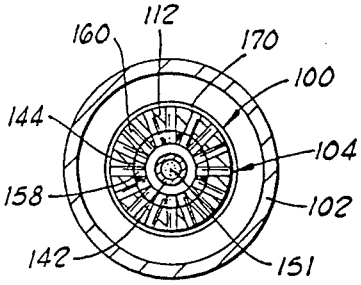
FIG. 10 is a sectional view taken along line 10—10 of FIG. 8.

Referring now to FIGS. 8, 9 and 10, an alternate embodiment of the apparatus of the present invention is illustrated and generally designated by the numeral 100. The apparatus 100 is shown positioned within a conduit 102 to be severed. The apparatus 100 is similar to the apparatus 10 previously described in that it includes an elongated closed cylindrical housing, generally designated by the numeral 104, comprised of a wireline connector assembly 106 threadedly connected to a fuel ignition subassembly 110 which is in turn threadedly connected to a housing sleeve 112. The bottom of the housing sleeve 112 is closed by a plug 114 threadedly connected thereto.

The wireline connector assembly 106 is identical to the assembly 26 previously described in connection with the apparatus 10 and includes a wireline or cable 116 connected thereto and electrical leads 118 and 120. The ignitor assembly 108 is identical to the ignitor assembly 28 described previously in connection with the apparatus 10 and includes an ignitor 122 threadedly connected within a centrally positioned passage 124 disposed in the subassembly 108. The ignitor element 126 of the ignitor 122 extends into the passage 124.

The fuel ignition subassembly 110 includes an insert 128 formed of heat resistant material and positioned within the subassembly 110 at the upper end portion thereof. The insert 128 includes a first passage 130 communicated with the passage 124 in the subassembly 108 which extends diagonally downwardly and intersects a second passage 132 positioned horizontally therein. A third passage 134 which is offset from the first passage 130 diagonally intersects the passage 132 and opens at the bottom of the insert 128. Thus, the passage through the insert 128 formed by the passages 130, 132 and 134 is of a zig-zag pattern whereby materials flowing through the passage must make two sharp turns. If the passage 132 in the insert 128 extends completely through the insert 128 as shown in FIG. 8, a liner 136 formed of heat resistant material is utilized therewith.

Positioned directly below and in contact with the insert 128 within the subassembly 110 is a second insert 138 formed of heat resistant material having a centrally positioned passage 140 extending therethrough which communicates with the passage 134 of the insert 128. Disposed within the passage 140 of the insert 138 is an ignition tube 142 which extends below the insert 138 into the upper end portion of the housing sleeve 112. Positioned directly below and in contact with the insert 138 within the upper end portion of the housing sleeve 112 is a cylindrical insert 144 formed of heat resistant material. The internal diameter of the insert 144 is greater than the outside diameter of the ignition tube 142 which extends the full length of the insert 144. Positioned immediately below the insert 144 and ignition tube 142, is an elongated fuel chamber liner 146 formed of heat resistant material and positioned below the liner 146 adjacent the plug 114 is a fuel chamber plug 148 formed of heat resistant material.

As will now be apparent, the space within the fuel chamber liner 146 between the fuel chamber plug 148 and the insert 144 constitutes a fuel chamber generally designated by the numeral 150, and the passage formed by the passage 124 in the subassembly 108, the passages 130, 132 and 134 in the insert 128 within the subassembly 110, the passage 140 in the insert 138 within the subassembly 110, and the internal space within the insert 144 disposed within the housing sleeve 112 form an ignition passage generally designated by the numeral 152. The ignition tube 142 functions as a retainer for powdered non-gas-forming pyrotechnic fuel 151 disposed within the ignition passage 152.

Disposed within the fuel chamber 150 are a plurality of stacked annular fuel pellets 154 formed of a solid gas-forming pyrotechnic fuel composition. The central openings in the fuel pellets 154 are filled with a powdered non-gas-forming pyrotechnic fuel composition 156.

A plurality of spaced, radially extending discharge nozzles, generally designated by the numeral 155, are disposed through the insert 144 and housing sleeve 112. More specifically, a first portion of the fuel discharge nozzles 155 are formed by passages 158 in the insert 144 and complementary passages 160 in the housing sleeve 112 which are positioned in a single plane extending transversely to the axis of the housing 104, preferably perpendicular thereto. A second portion of discharge nozzles are formed by passages 162 in the insert 144 and complementary passages 164 in the housing sleeves 112. The second portion of discharge nozzles 155 are positioned on equal oblique angles with respect to the axis of the housing 104. The interior ends of the second portion of the discharge nozzles 155 all lie in a single plane extending transversely to the axis of the housing 104 and the exterior ends of the second portion of nozzles 155 also lie in a single plane extending transversely to the axis of the housing 104, preferably perpendicular thereto immediately below the discharge ends of the first portion of nozzles 155. As described previously in connection with the apparatus 10, and as best shown in FIG. 10, the nozzles 155 are equally spaced around the insert 144 and housing sleeve 112 and the first portion of discharge nozzles 155 are positioned in a staggered relationship with respect to the second portion of the discharge nozzles 155, i.e., the discharge ends of the nozzles of the first portion do not align vertically with the discharge ends of the nozzles of the second portion.

As indicated above, the ignition passages 152 is filled with a powdered non-gas-forming pyrotechnic fuel composition 151, i.e., the passage 124 of the subassembly 128, the passages through the insert 128 in the subassembly 110, and the internal portion of the ignition tube 142 are filled with the powdered non-gas-forming pyrotechnic fuel composition 151. The spaces between the outside surface of the ignition tube 142 and the inside surfaces of the insert 144 and the discharge nozzles 155 are not filled with fuel composition. A sleeve 170 which can be formed of metal or which can be aluminum tape or the like is sealingly positioned over the discharge ends of the nozzles 155 in the housing sleeve 112.

In operation of the apparatus 100 for severing the conduit 102, it is lowered by means of the cable 116 within the conduit 102 to a location whereby the discharge nozzles 155 are positioned opposite the desired location of severance of the conduit 102. A source of electric power is caused to complete the circuit to the ignitor 122 by way of electric leads 118 and 120 whereby the ignitor element 126 is heated and ignites the non-gas-forming pyrotechnic fuel composition 151 disposed within the ignition passage 152. The ignition and reaction of the non-gas-forming fuel composition 151 within the ignition passage ignites the non-gas-forming and the gas-forming pyrotechnic fuel compositions 154 and 156 within the fuel chamber 150. The ignition of the gas-forming fuel composition causes extremely hot reaction products to burn through the ignition tube 142, to flow through the discharge nozzles 155, to burn through the sleeve 170 and high velocity jets of extremely hot dense reaction products to impinge against and burn through the conduit 102 whereby the conduit 102 is severed in a plane transverse to the axis thereof. Once all the pyrotechnic fuel composition within the apparatus 100 has been reacted and the conduit 102 severed, the apparatus 100 is removed from the conduit 102 by means of the cable 116.

In order to prevent the extremely hot reaction products from flowing upwardly through the passage 152 into contact with the ignitor 122 and the possible burning out of the ignitor, etc., the zig-zag passage in the insert 128 formed by the passages 130, 132 and 134 is utilized. The zig-zag pattern causes any reaction products tending to flow upwardly in the passage 152 to make two sharp turns whereby the reaction products are slowed down and cooled before reaching the ignitor 122.

As will be understood by those skilled in the art, the alternate embodiments of the apparatus of this invention as illustrated in FIGS. 1–7 and 8–10 are presented to illustrate that a variety of embodiments of the apparatus can be utilized and that a specific arrangement and construction of the various parts of the apparatus is not essential to the invention. Generally, the apparatus of this invention, in whatever specific embodiment utilized, includes a single fuel chamber in communication with a plurality of spaced radially extending discharge nozzles in combination with means for igniting a gas-forming pyrotechnic fuel composition contained within the fuel chamber. In preferred embodiments of the apparatus, the fuel chamber is communicated with the discharge nozzles by way of an ignition passage which extends upwardly to an ignitor positioned at the upper end of the apparatus. However, the fuel chamber and ignitor can be located in various positions within the elongated housing and such locations are not critical to the invention. Further, in a preferred embodiment, a space between the pyrotechnic fuel and the plurality of discharge nozzles is provided within the housing to insure the ability of the reaction products formed to flow through the discharge nozzles without plugging some or all of the nozzles. As between the apparatus illustrated in FIGS. 1–7 and 8–10 and described herein, the apparatus illustrated in FIGS. 1–7 is the most preferred.

Generally, when the apparatus 10 or the apparatus 100 or other apparatus combining the elements of the apparatus 10 and the apparatus 100 are utilized in high pressure applications and/or applications where the apparatus is submerged in a liquid, a sleeve for sealing the discharge ends of the fuel reaction products discharge nozzles is utilized in an arrangement like that shown in FIG. 1 wherein the sleeve 96 is sealed by means of O-rings or other sealing means which can withstand superatmospheric pressure and prevent fluids from entering the apparatus by way of the discharge nozzles. In applications where the apparatus is not submerged beneath the surface of a liquid or subjected to high pressure, the sealing sleeve can be like that shown and described in connection with sleeve 170 in the apparatus of FIG. 8, wherein sealing means are not utilized or the sleeve is formed of aluminum tape or the like. In addition, one or more of the discharge nozzles of the apparatus of this invention can be positioned on lines deviating from radial lines whereby the apparatus is caused to rotate around its longitudinal axis within the conduit being severed when the jets of hot reaction products are discharged therefrom. The rotation of the apparatus facilitates a smooth cut or severance of the conduit.

As stated above, the discharge nozzles 86 and 155 in the apparatus 10 and 100 are positioned whereby at least a portion of the nozzles direct fuel reaction products discharged from the apparatus upwardly. This creates a downward force on the apparatus against the restraint provided by the cable attached to the apparatus and prevents the apparatus from moving vertically during operation.

While a variety of gas-forming and non-gas-forming pyrotechnic fuel compositions can be utilized in the apparatus of this invention, the compositions of this invention are particularly suitable for such use in that they are economical to produce and efficient in operation over a broad temperature and pressure range. The compositions of this invention are more effective than other similar compositions in high pressure applications and produce greater penetration at atmospheric pressure.

The gas-forming pyrotechnic fuel compositions of this invention are comprised of a mixture of a metal selected from the group consisting of aluminum, magnesium, niobium, titanium or mixtures of such metals, a metal oxide selected from the group consisting of ferric oxide, ferrous oxide, ferrosoferric oxide, cupric oxide, chromium trioxide and mixtures thereof and a gas-forming component which vaporizes to form a gas when heated to the temperature at which said metal and said metal oxide react when ignited. While various gas-forming materials, both liquid and solid can be utilized, the preferred such material is polytetrafluoroethylene. Of the metals which can be utilized, aluminum is preferred and of the metal oxides which can be utilized, a metal oxide selected from the group consisting of ferric oxide, cupric oxide and mixtures thereof is preferred.

The non-gas-forming pyrotechnic fuel compositions of this invention are comprised of a metal selected from the group consisting of aluminum, magnesium, niobium, titanium and mixtures of such metals, and a metal oxide selected from the group consisting of ferric oxide, ferrous oxide, ferrosoferric oxide, cupric oxide, chromium trioxide and mixtures thereof with aluminum and a metal oxide selected from the group consisting of ferric oxide, cupric oxide and mixtures thereof being the most preferred.

A particularly suitable composition of this invention for use in apparatus for severing conduits over a broad temperature and pressure range is comprised of a metal selected from the group consisting of aluminum, magnesium, niobium, titanium and mixtures of such metals present in the composition in an amount in the range of from about 8% to about 70% by weight of the composition, a metal oxide selected from the group consisting of ferric oxide, ferrous oxide, ferrosoferric oxide, cupric oxide, chromium trioxide and mixtures thereof present in the composition in an amount in the range of from about 12% to about 80% by weight of the composition, and polytetrafluoroeethylene present in the composition in an amount in the range of from about 1% to about 60% by weight of the composition.

A particularly suitable non-gas-forming pyrotechnic fuel composition of this invention is comprised of a metal selected from the group consisting of aluminum, magnesium, niobium, titanium and mixtures thereof present in the composition in an amount in the range of from about 15% to about 80% by weight of the composition and a metal oxide selected from the group consisting of ferric oxide, ferrous oxide, ferrosoferric oxide, cupric oxide, chromium trioxide and mixtures thereof present in the composition in an amount in the range of from about 20% to about 85% by weight. The most preferred non-gas-forming pyrotechnic fuel composition of this invention is comprised of aluminum present in the composition in an amount of about 30% by weight and a metal oxide selected from the group consisting of ferric oxide, cupric oxide and mixtures thereof present in the composition in an amount of about 70% by weight of the composition.

In high pressure environment applications it is advantageous to utilize a gas-forming pyrotechnic fuel composition load in the severing apparatus used wherein the load is formed into a stacked configuration of two types of solid fuel pellets, the first type of fuel pellet having less gas-forming component therein than the second type of fuel pellet. The fuel composition load is stacked with adjacent fuel pellets in the stack being of different types. More specifically, the first fuel pellet in the load which is ignited first is preferably formed of a pyrotechnic fuel composition having a relatively low content of gas-forming component with the next adjacent pellet having a high concentration of gas-forming component, the next adjacent fuel pellet having a low concentration of gas-forming component and so on. This stacked configuration of fuel pellets of alternating gas-forming component concentration insures the rapid and complete reaction of the fuel composition as well as the production of high velocity jets of reaction products in a high pressure environment.

The preferred gas-forming pyrotechnic fuel composition for use in the first type of fuel pellet described above is comprised of aluminum present in the composition in an amount of about 25.5% by weight, a metal oxide selected from the group consisting of ferric oxide, cupric oxide and mixtures thereof present in an amount of about 59.5% by weight of the composition and polytetrafluoroethylene present therein in an amount of about 15% by weight.

A preferred gas-forming pyrotechnic fuel composition for use in the pellets of the second type described above is comprised of aluminum present in an amount of about 7.5% by weight, a metal oxide selected from the group consisting of ferric oxide, cupric oxide and mixtures thereof present in an amount of about 17.5% by weight and polytetrafluoroethylene present therein in an amount of about 75% by weight.

The preferred gas-forming composition of this invention for use in applications at atmospheric or relatively low pressure environments is comprised of aluminum present in the composition in an amount of about 25.5% by weight, a metal oxide selected from the group consisting of ferric oxide, cupric oxide and mixtures thereof present in the composition in an amount of about 59.5% by weight and polytetrafluoroethylene present in the composition in an amount of about 15% by weight.

Generally, the ratio of the weight of gas-forming pyrotechnic fuel composition utilized in the apparatus 10 and/or 100 to the weight per foot of material in the conduit to be severed thereby is in the range of from about 0.32 to about 0.41. The ratio of the outside diameter of the housing of the apparatus at the location of the discharge nozzles therein to the inside diameter of the conduit to be severed is generally within the range of from about 0.87 to slightly less than 1.

In order to facilitate a clear understanding of the methods, apparatus and compositions of this invention, the following examples are given.

EXAMPLE 1

Figure 11:
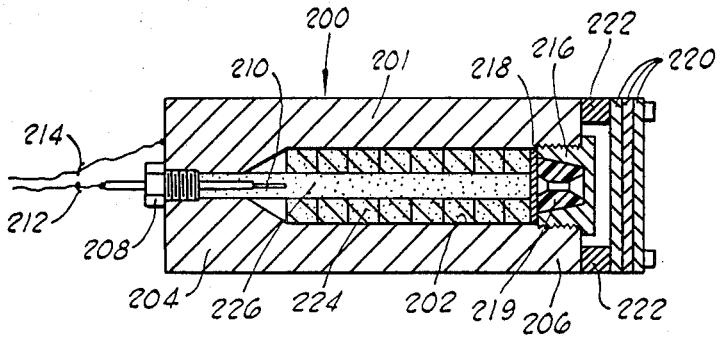
FIG. 11 is a sectional view of test apparatus for determining the penetration of various pyrotechnic fuel compositions.

A test apparatus of the type illustrated in FIG. 11 is immersed in water in a pressure vessel and operated at various pressure conditions using a gas-forming pyrotechnic fuel composition of the present invention and a prior art composition containing nickel. Referring to FIG. 11, the test apparatus, generally designated by the numeral 200 is comprised of a steel housing 201 having a longitudinally extending passage 202 centrally disposed therein. The passage 202 is of a relatively small diameter at the forward end 204 of the housing 201 and of larger diameter over its remaining length including the rearward end 206 thereof. An ignitor 208 having an ignitor element 210 is threadedly connected in the passage 202 at the forward end 204 of the housing 201 and electrical leads 212 and 214 are selectively connected to a source of electric power. An aluminum plug 216 is threadedly connected in the passage 202 at the rearward end 206 of the housing 201. The plug 216 includes a hollow interior in which a graphite nozzle member 219 is disposed. The enlarged portion of the passage 202 between the ignitor 208 and the nozzle 219 and plug 216 is filled with annular solid fuel pellets 224 of gas-forming pyrotechnic fuel composition. The central openings of the fuel pellets and the forward portion of the passage 202 in the housing 201 are filled with powdered non-gas-forming pyrotechnic fuel composition 226. A retainer 218 formed of thin aluminum is positioned between the nozzle 219 and plug 216 and the pyrotechnic fuel compositions. Three steel plates 220 are bolted to the rearward end 206 of the housing 200 adjacent the nozzle 216 and are separated from the face of the nozzle 216 by spacers 222. The non-gas-forming pyrotechnic fuel composition used in the test apparatus is comprised of 30% by weight aluminum and 70% by weight cupric oxide.

The gas-forming pyrotechnic fuel composition of the present invention used in the test apparatus is comprised of aluminum present in the composition in an amount of 25.5% by weight of the composition, ferric oxide present in the composition in an amount of 59.5% by weight of the composition and polytetrafluroethylene present in the composition in an amount of 15% by weight of the composition. The test apparatus 200 is operated immersed in water at various pressures by connecting a source of power to the leads 212 and 214 which in turn causes the ignitor element 210 to heat and ignite the powdered non-gas-forming pyrotechnic fuel composition within the housing 201. The ignition of the non-gas-forming pyrotechnic fuel composition 226 causes the gas-forming fuel pellets 224 to be ignited which in turn causes the retainer 218 to rupture and a jet of fuel reaction products to flow through the nozzle 219, burn through the plug 216 and impact the steel plates 220. After each test the penetration caused by the jet of fuel reaction products on the plates 220 is determined.

The procedure described above is repeated using a prior art gas-forming pyrotechnic fuel composition which includes nickel comprised of aluminum in an amount of 24.6% by weight of the composition, nickel in an amount of 17.8% by weight of the composition, ferric oxide in an amount of 48.5% by weight of the composition and polytetrafluoroethylene in an amount of 9.1% by weight of the composition.

Figure 12:
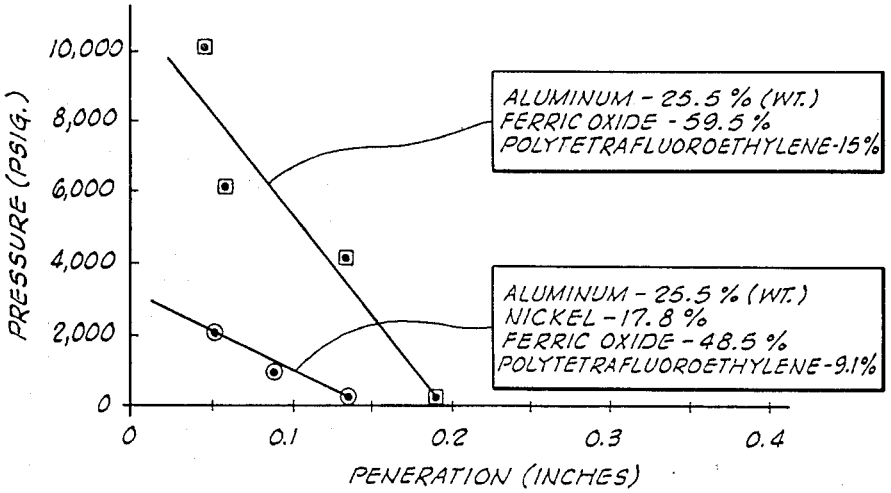
FIG. 12 is a graph illustrating the penetration achieved by pyrotechnic fuel compositions at various pressures.

The resuls of these tests are shown graphically in FIG. 12, and as can readily be seen, the composition of the present invention achieves a significantly greater penetration at pressures from slightly above atmospheric to 10,000 psig as compared to the prior art pyrotechnic fuel composition containing nickel.

EXAMPLE 2

Conduit severing apparatus 10 having an outside diameter at the sleeve 96 of 1-11/16 inches is positioned in a section of $2\frac{3}{8}$ inches O.D. tubing having a 0.19 inch wall thickness under 10 feet of water. Nine gas-forming pyrotechnic fuel pellets 82 are utilized in the fuel chamber 78 of the apparatus with the first, third, fifth, seventh and ninth fuel pellets (top to bottom) being comprised of 25.5% by weight aluminum, 59.5% by weight ferric oxide and 15% by weight polytetrafluoroethylene, each of the pellets having a density of 2.6 grams per cubic centimeter and a weight of 39.5 grams. The second, fourth, sixth and eighth fuel pellets are comprised of 7.5% by weight aluminum, 17.5% ferric oxide and 75% by weight polytetrafluoroethylene, each of the pellets having a density of 2.40 grams per cubic centimeter and a weight of 35 grams.

The powdered non-gas-forming pyrotechnic fuel composition utilized in the apparatus 10 is comprised of 30% by weight aluminum and 70% by weight cupric oxide and the solid gas-forming pellets 62 and 64 are comprised of 25.5% by weight aluminum, 59.5% by weight ferric oxide and 15% by weight polytetrafluoroethylene. The apparatus includes 16 equally spaced $\frac{1}{8}$ inch diameter fuel discharge nozzles 86.

Upon operation, the apparatus successfully severs the $2\frac{3}{8}$ inch O.D. tubing.

What is claimed is:

1. A gas-forming pyrotechnic fuel composition load for use in apparatus for severing conduits in high pressure environments comprising a plurality of stacked fuel pellets of a mixture of (a) a metal selected from the group consisting of aluminum, magnesium, niobium, titanium and mixtures thereof, (b) a metal oxide selected from the group consisting of ferric oxide, ferrous oxide, ferrosoferric oxide, cupric oxide, chromium trioxide and mixtures thereof, and (c) a gas-forming component which vaporizes to form a gas when heated to the temperature at which said metal and said metal oxide react when ignited wherein alternate fuel pellets of said load have alternate amounts of said gas-forming component.

2. The fuel composition load of claim 1 wherein the first fuel pellet in the stacked load has less gas-forming component therein than the next adjacent fuel pellet.

3. The fuel composition load of claim 2 wherein said gas-forming component is polytetrafluoroethylene.

4. The fuel composition load of claim 3 wherein said metal is aluminum and said metal oxide is selected from the group consisting of ferric oxide, cupric oxide and mixtures thereof.

5. The fuel composition load of claim 4 wherein aluminum is present in said composition in an amount in the range of from about 8% to about 70% by weight of said composition.

6. The fuel composition load of claim 5 wherein said metal oxide is present in said composition in an amount in the range of from about 12% to about 80% by weight of said composition.

7. The composition load of claim 6 wherein said polytetrafluoroethylene is present in said composition in an amount in the range of from about 1% to about 60% by weight of said composition.

8. The fuel composition load of claim 2 wherein said first fuel pellet comprises aluminum present therein in an amount of about 25.5% by weight, a metal oxide selected from the group consisting of ferric oxide, cupric oxide and mixtures thereof present therein in an amount of about 59.5% by weight and polytetrafluoroethylene present therein in an amount of about 15% by weight.

9. The fuel composition load of claim 8 wherein said next adjacent fuel pellet comprises aluminum present therein in an amount of about 7.5% by weight, a metal oxide selected from the group consisting of ferric oxide, cupric oxide and mixtures thereof present therein in an amount of about 17.5% by weight and polytetrafluoroethylene present therein in an amount of about 75% by weight.

10. The fuel composition load of claim 9 wherein each of said fuel pellets is annular in shape and the central opening in said pellets is filled with powdered non-gas-forming pyrotechnic fuel composition.

11. The fuel composition load of claim 10 wherein said powdered non-gas-forming pyrotechnic fuel composition within the central openings of said fuel pellets comprises aluminum present in said composition in an amount of about 30% by weight and a metal oxide selected from the group consisting of ferric oxide, cupric oxide and mixtures thereof present in said composition in an amount of about 70% by weight.

* * * * *